US009963929B2

(12) United States Patent
Glass

(10) Patent No.: US 9,963,929 B2
(45) Date of Patent: May 8, 2018

(54) ASSEMBLY AND METHOD FOR SECURING A DOOR OPENING OR OTHER OPENING OF A BUILDING STRUCTURE

(71) Applicant: DOOR & WINDOW GUARD SYSTEMS, INC., Inverness, IL (US)

(72) Inventor: James D. Glass, Inverness, IL (US)

(73) Assignee: DOOR & WINDOW GUARD SYSTEMS, INC., Inverness (IL)

( * ) Notice: Subject to any disclaimer, the term of this patent is extended or adjusted under 35 U.S.C. 154(b) by 0 days. days.

(21) Appl. No.: 15/250,099

(22) Filed: Aug. 29, 2016

(65) Prior Publication Data

US 2018/0058140 A1 Mar. 1, 2018

(51) Int. Cl.

| | |
|---|---|
| ***E06B 1/04*** | (2006.01) |
| ***E06B 5/11*** | (2006.01) |
| ***E06B 1/60*** | (2006.01) |
| ***E06B 1/12*** | (2006.01) |
| ***E06B 1/52*** | (2006.01) |
| ***E06B 3/82*** | (2006.01) |
| ***E06B 3/70*** | (2006.01) |
| ***E05B 59/00*** | (2006.01) |
| ***E05C 1/10*** | (2006.01) |

(52) U.S. Cl.

CPC ..... *E06B 5/11* (2013.01); *E05B 59/00* (2013.01); *E05C 1/10* (2013.01); *E06B 1/12* (2013.01); *E06B 1/52* (2013.01); *E06B 1/60* (2013.01); *E06B 3/70* (2013.01); *E06B 3/827* (2013.01); *E06B 2003/7046* (2013.01); *E06B 2003/7049* (2013.01)

(58) Field of Classification Search

CPC ... E05C 1/10; E06B 5/11; E06B 59/00; E06B 3/70; E06B 3/827; E06B 1/60; E06B 1/12; E06B 1/52; E06B 2003/7046; E06B 2003/7049

USPC ..... 52/215, 204.1, 238.1

See application file for complete search history.

(56) References Cited

U.S. PATENT DOCUMENTS 1,788,928 A * 1/1931 Mills ..... E06B 5/003 49/169

2,549,661 A 4/1951 Carney (Continued)

FOREIGN PATENT DOCUMENTS

| | | |
|---|---|---|
| GB | 2160248 | 12/1985 |
| GB | 2270336 | 3/1994 |
| GB | 2277548 | 11/1994 |

OTHER PUBLICATIONS

Brochure, "National Arson Prevention Initiative board up procedures," U.S. Fire Administration (2003).

*Primary Examiner* — Basil S Katcheves

(74) *Attorney, Agent, or Firm* — Barnes & Thornburg LLP

(57) ABSTRACT

An assembly for securely enclosing an opening defined by a building structure comprising a frame sized to be disposed to substantially surround the opening and engage the structure and a panel pivotally securable to the frame and sized to substantially cover the opening, the panel having a front and a back. Locking means for selectively locking the panel to the frame in a closed position and unlocking the panel so that it can be pivoted to an open position, the locking means comprising selectively an internal locking means manually operable only from the inside of the building and an external locking means manually operable from the outside of the building.

16 Claims, 9 Drawing Sheets

(56) References Cited

U.S. PATENT DOCUMENTS 2,611,933 A 9/1952 Comfort
2,622,285 A 12/1952 Roos
2,772,447 A 12/1956 Preston
3,120,032 A * 2/1964 Burnette ..... E05B 65/1033 292/92
3,978,614 A 9/1976 Goldhaber
4,098,025 A 7/1978 Stock et al.
4,175,357 A 11/1979 Goldhaber
4,288,944 A * 9/1981 Donovan ..... E05C 9/042 292/39
4,520,736 A * 6/1985 Crosby ..... E05B 17/0062 109/60
4,606,566 A * 8/1986 Bott ..... E05C 19/003 292/57
4,938,154 A 7/1990 Watt
5,207,022 A 5/1993 Watt
5,289,655 A 3/1994 Marmora et al.
5,335,452 A 8/1994 Taylor
5,365,706 A 11/1994 Elsenpeter et al.
5,472,247 A * 12/1995 Monson ..... E05C 9/06 292/167
5,487,237 A 1/1996 Martin, Jr.
5,683,123 A 11/1997 Ruoss
5,722,206 A 3/1998 McDonald
5,737,874 A 4/1998 Sipos et al.
5,778,708 A * 7/1998 Crosby ..... E05B 65/0075 109/59 R
5,832,671 A 11/1998 White
5,832,758 A * 11/1998 White ..... E05B 15/004 292/DIG. 62
5,852,903 A 12/1998 Astrizky
5,937,593 A 8/1999 White
6,115,977 A * 9/2000 Hornberger ..... A47B 95/008 52/238.1
6,185,871 B1 * 2/2001 Wang ..... E05B 63/20 49/501
6,205,713 B1 3/2001 Thompson et al.
6,216,391 B1 * 4/2001 Garrett, Jr. ..... E05B 53/003 49/141
6,345,476 B1 2/2002 Hill
6,375,244 B1 * 4/2002 Smeltzer ..... E05C 9/041 292/32
6,510,654 B1 * 1/2003 McCracken ..... E06B 9/01 49/50
7,650,723 B1 1/2010 Kotlarich
7,775,002 B2 8/2010 Puchniak
7,908,803 B2 3/2011 Puchniak
8,046,967 B2 11/2011 Suare
8,459,704 B2 * 6/2013 Daniels ..... E05B 13/04 292/137
8,490,346 B2 7/2013 Wedren
8,656,642 B2 * 2/2014 Boens ..... E06B 7/36 49/170
9,562,379 B2 * 2/2017 Olsen ..... E05C 9/06
2003/0067176 A1 * 4/2003 Stevens ..... E05B 17/2084 292/339
2004/0055218 A1 3/2004 Forsyth et al.
2009/0090062 A1 4/2009 Pandorf
2011/0107692 A1 5/2011 Duncan
2012/0167476 A1 * 7/2012 Weinerman ..... F41H 5/226 49/460
2013/0111833 A1 * 5/2013 Glass ..... E06B 5/025 52/204.1

* cited by examiner

ASSEMBLY AND METHOD FOR SECURING A DOOR OPENING OR OTHER OPENING OF A BUILDING STRUCTURE

The present disclosure relates to an assembly and method for securing a door opening or other opening of a building.

BACKGROUND

Abandoned, vacant, fire damaged, or buildings undergoing rehab are often targets for trespassers and for criminal or dangerous activity because, among other reasons, such structures typically include doors and windows which allow ready entry and egress into the structures. It is difficult to adequately secure the doors and windows or to otherwise keep trespassers from being readily able to break and enter into such structure through the doors or windows using wood, dogs or guards. Not only can criminal or other dangerous activity of trespassers detrimentally impact the value of the property, it also creates significant liability risks to the property owners and public safety personnel and causes a drain on public safety personnel through the need to patrol, nuisance calls, and fires.

The recent economic down turn in conjunction with the collapse several years ago of the real estate market has created thousands, if not hundred of thousands, of abandoned or vacant buildings, dwellings, commercial buildings or other structures that are unsecured from criminal removal of items therein, including appliances, windows, furnaces, copper pipe, copper tube, copper wire, etc. Additionally, because such structures typically become abandoned or vacated due to poor economic circumstances, it follows that the funds available to secure or protect such abandoned or vacant structures from trespassers and criminal activity typically are substantially limited.

U.S. Pat. Nos. 8,656,664 and 8,756,883 provide examples of systems and assemblies for securing doors and windows of abandoned or vacant homes. Although these systems and assemblies have achieved success in the marketplace, as with any industry, there are benefits to increasing efficiencies and reducing costs.

SUMMARY

The present disclosure is directed to an assembly for securely enclosing an opening defined by a building structure having an inside and an outside. The assembly comprises a frame sized to be disposed to substantially surround the opening and engage the structure and a panel pivotally securable to the frame and sized to substantially cover the opening, the panel having a front and a back. The panel may be comprised of cold rolled steel or any other suitable steel or metal. The assembly includes locking means for selectively locking the panel to the frame in a closed position and unlocking the panel so that it can be pivoted to an open position.

The locking means comprises selectively an internal locking means manually operable only from the inside of the building and an external locking means manually operable from the outside of the building. The internal locking means has at least one handle assembly configured to be secured to the back of the panel. The handle assembly comprises a handle and a latch bolt. The handle assembly is configured to selectively engage and disengage the latch bolt and the frame for selectively locking and unlocking the panel. The external locking means comprises a handle assembly including a handle and a latch bolt operatively connectable to the handle of the external locking means. The handle assembly of the external locking means is configured to selectively engage and disengage the latch bolt of the external locking means and the frame for selectively locking and unlocking the panel.

The internal locking means may comprise a mounting panel for securing the handle of the internal locking means to the back of the panel and the external locking means includes a mounting plate for securing the handle of the external locking means to the front of the panel. One or more fasteners may be included that are receivable in one or more holes defined by the panel for selectively securing the mounting plate of the internal locking means to the back of the panel and the mounting plate of the external locking means to the front of the panel.

The assembly may also include a pair of spaced brackets on the back and the internal locking means may comprise a pair of other handle assemblies. Each other handle assembly may comprise a handle engaged with a respective bracket and a latch bolt moveable by the handle relative to the respective bracket to selectively engage or disengage the latch bolt of the other handle assembly and the frame. The internal locking means may also comprise three latch assemblies secured to the frame. Each latch assembly of the internal locking means is engageable with a latch bolt of a respective handle assembly and other handle assembly of the internal locking means.

The external locking means may further include another pair of other latch bolts. Each of these other latch bolts of the external locking means is configured to engage a respective bracket and to selectively engage or disengage the frame during engagement or disengagement of the respective latch bolt of the external locking means and the frame. The external locking means may further include a cable assembly operatively associated with the handle to selectively engage or disengage these other latch bolts to facilitate engagement and disengagement of the respective latch bolt of the external locking means and the frame. The external locking means further includes a protective shroud securable to the back of the panel to enclose the cable assembly.

The assembly may also include at least one installation bar to secure the frame to the building structure and a pair of spaced brackets on the back of the panel for receiving and storing the installation bar during storage or transportation of the assembly. It may also include a tube on the back of the panel for receiving and storing at least some of the locking means during storage or transportation of the assembly.

Features and advantages of the disclosure will be set forth in part in the description which follows and the accompanying drawings described below, wherein one or more embodiments of the disclosure is described and shown, and in part will become apparent upon examination of the following detailed description taken in conjunction with the accompanying drawings.

BRIEF DESCRIPTION OF THE DRAWINGS

The present disclosure and the advantages thereof will become more apparent upon consideration of the following detailed description when taken in conjunction with the accompanying drawings.

DETAILED DESCRIPTION

Figure 2:
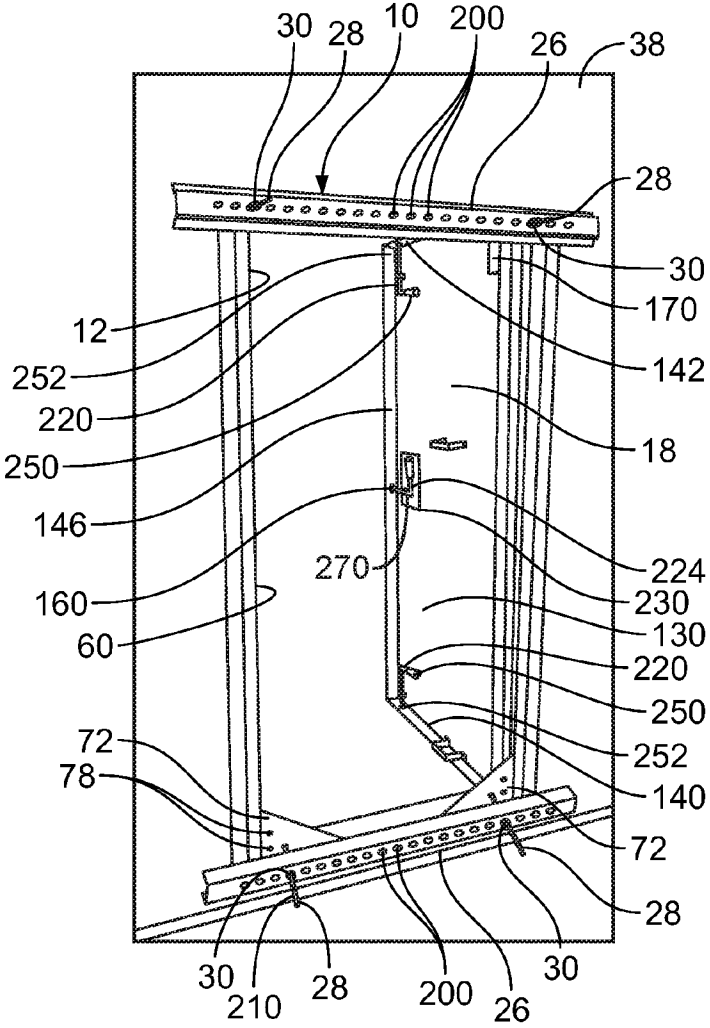
FIG. 2 is a back view of the assembly of FIG. 1 with the panel of the assembly shown in the open position.
Figure 1:
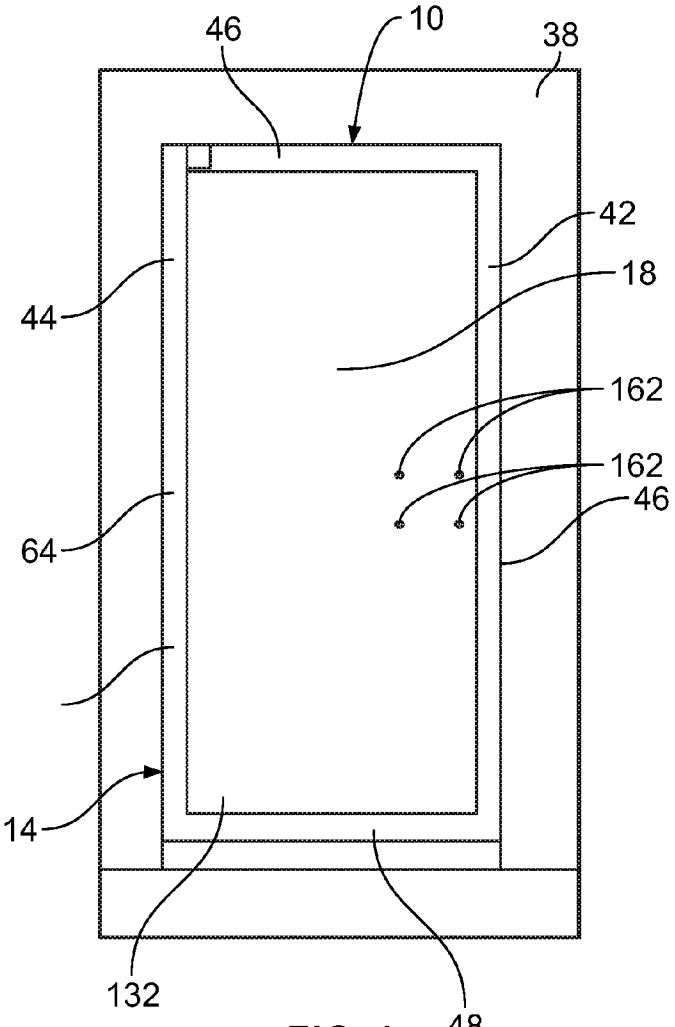
FIG. 1 is a front view of an assembly with an internal locking means in accordance with an illustrated embodiment of the present disclosure shown secured to a structure of a house or other building and with the panel of the assembly shown in the closed position.
Figure 4:
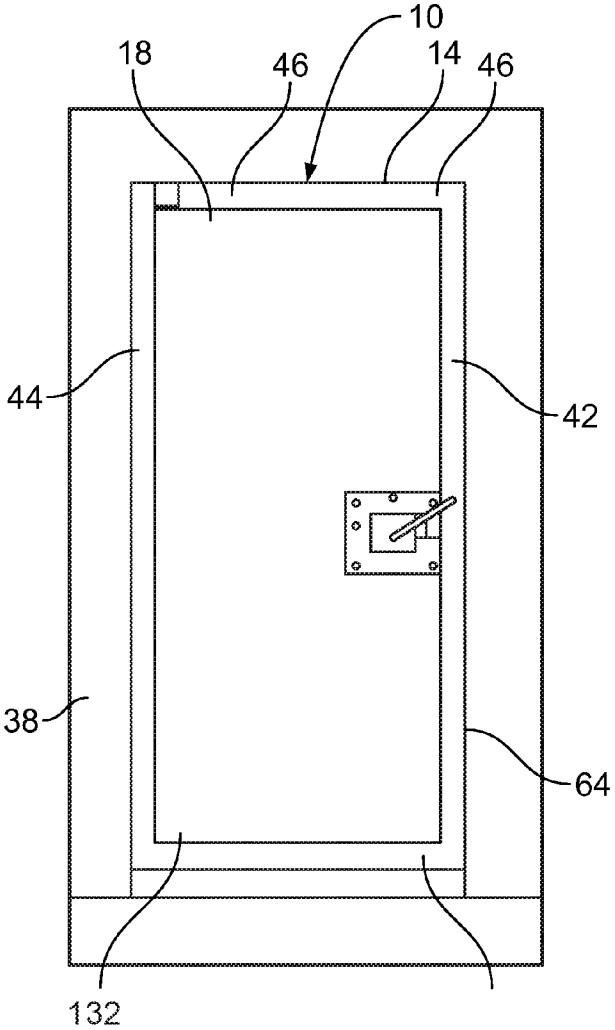
FIG. 4 is a front view of an assembly with an external locking means in accordance with an illustrated embodiment of the present disclosure shown secured to a structure of a house or other building and with the panel of the assembly shown in the closed position.
Figure 3:
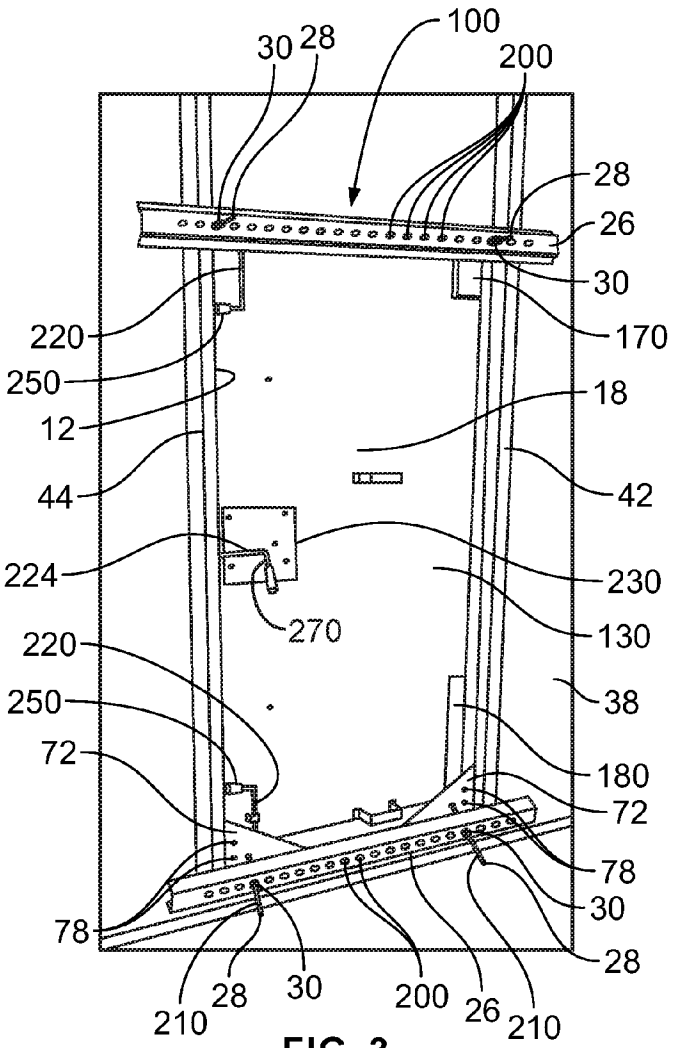
FIG. 3 is a back view of the assembly of FIG. 1 with the panel of the assembly shown in the closed position.
Figure 6:
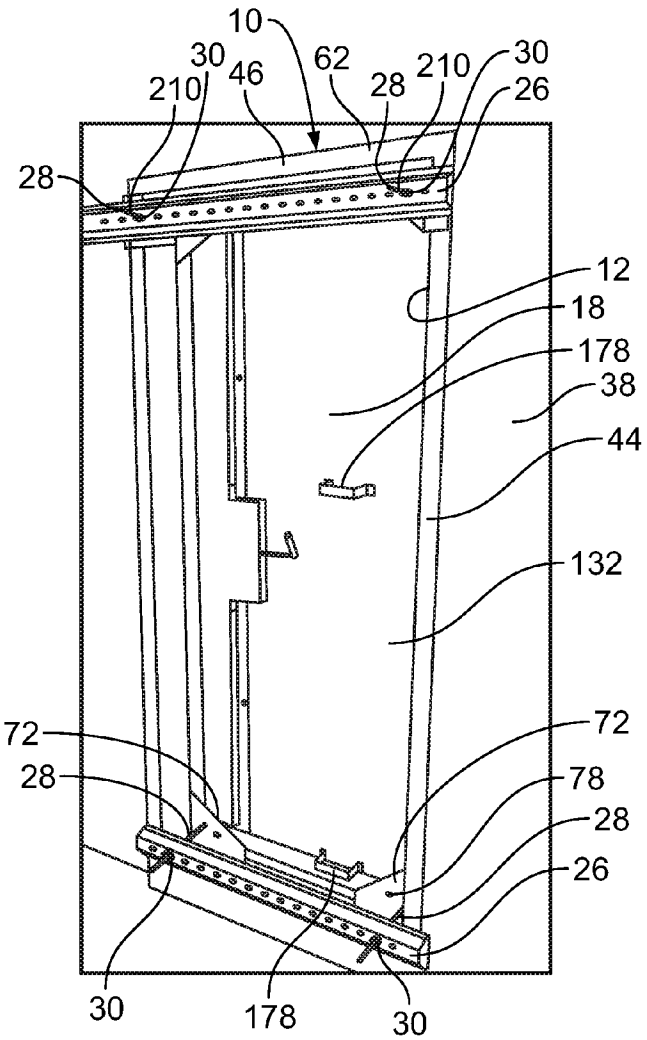
FIG. 6 is a back view of the assembly of FIG. 4 with the panel of the assembly shown in the closed position.
Figure 5:
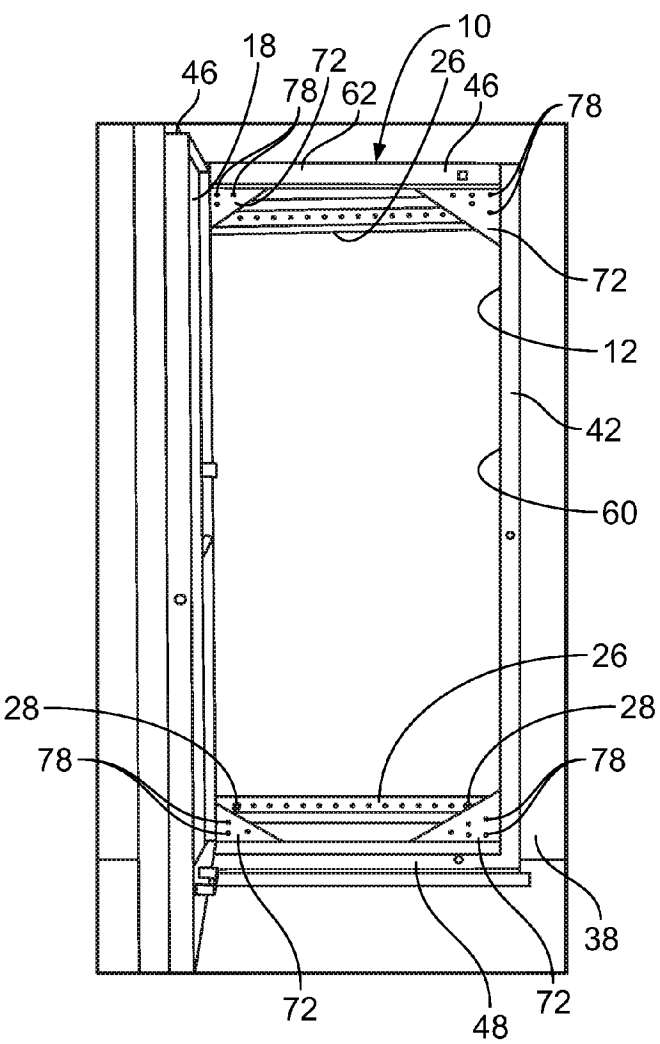
FIG. 5 is a back view of the assembly of FIG. 4 with the panel of the assembly shown in the open position.
Figure 8:
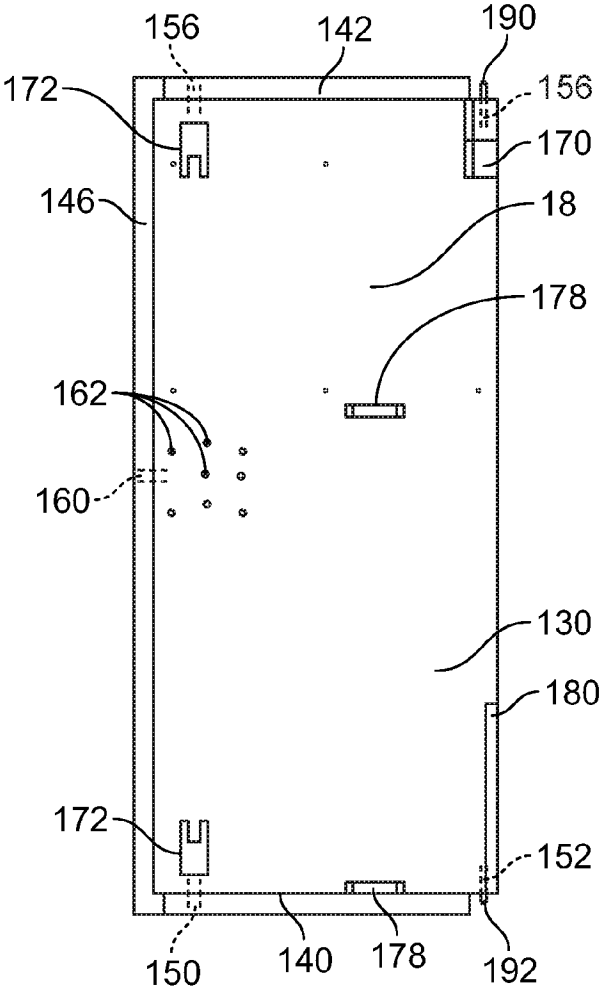
FIG. 8 is a back plan view of the front of the panel of FIG. 7.
Figure 7:
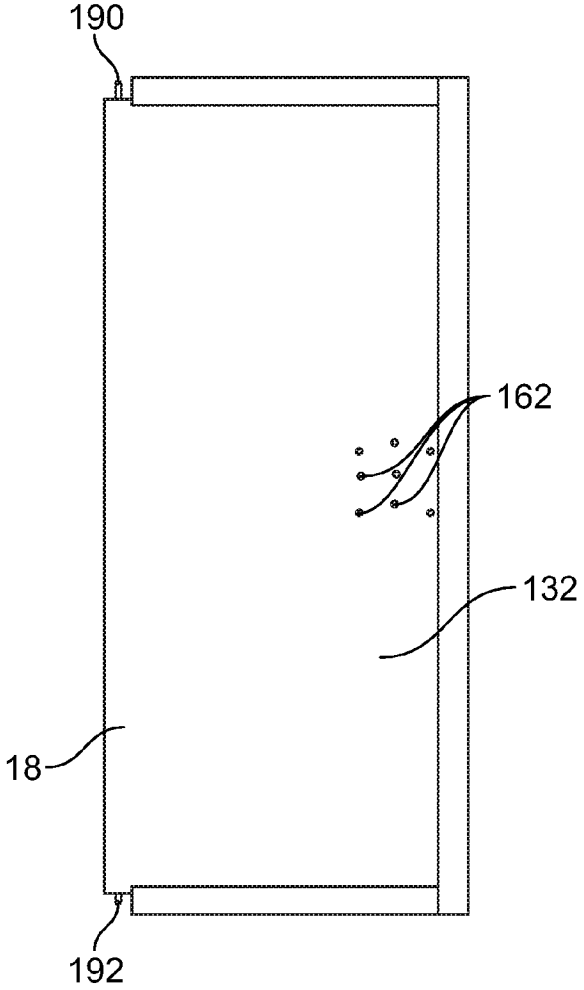
FIG. 7 is a front plan view of the front of the panel of the assembly of FIGS. 1-6 shown without the internal or external locking means.
Figure 9:
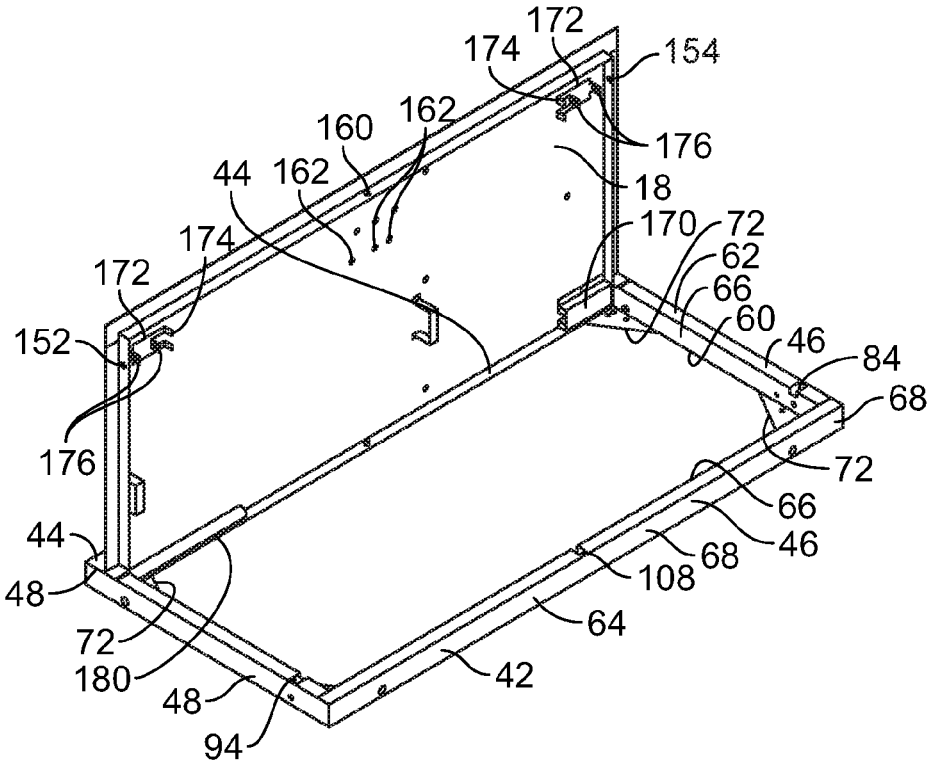
FIG. 9 is a front perspective view of the panel of the assembly of FIG. 1 or 4 without the internal or external locking means and with the panel of the assembly shown in the open position.
Figure 10:
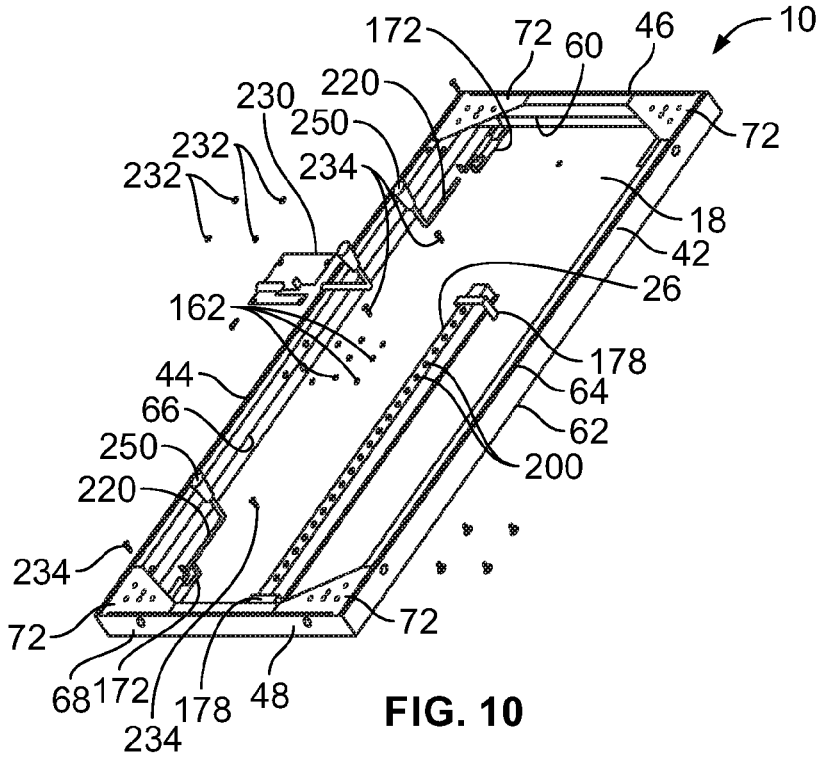
FIG. 10 is a partially-exploded and back perspective view of the assembly of FIG. 1 also illustrating an installation bar stored within a pair of brackets on the back of the panel.
Figure 11:
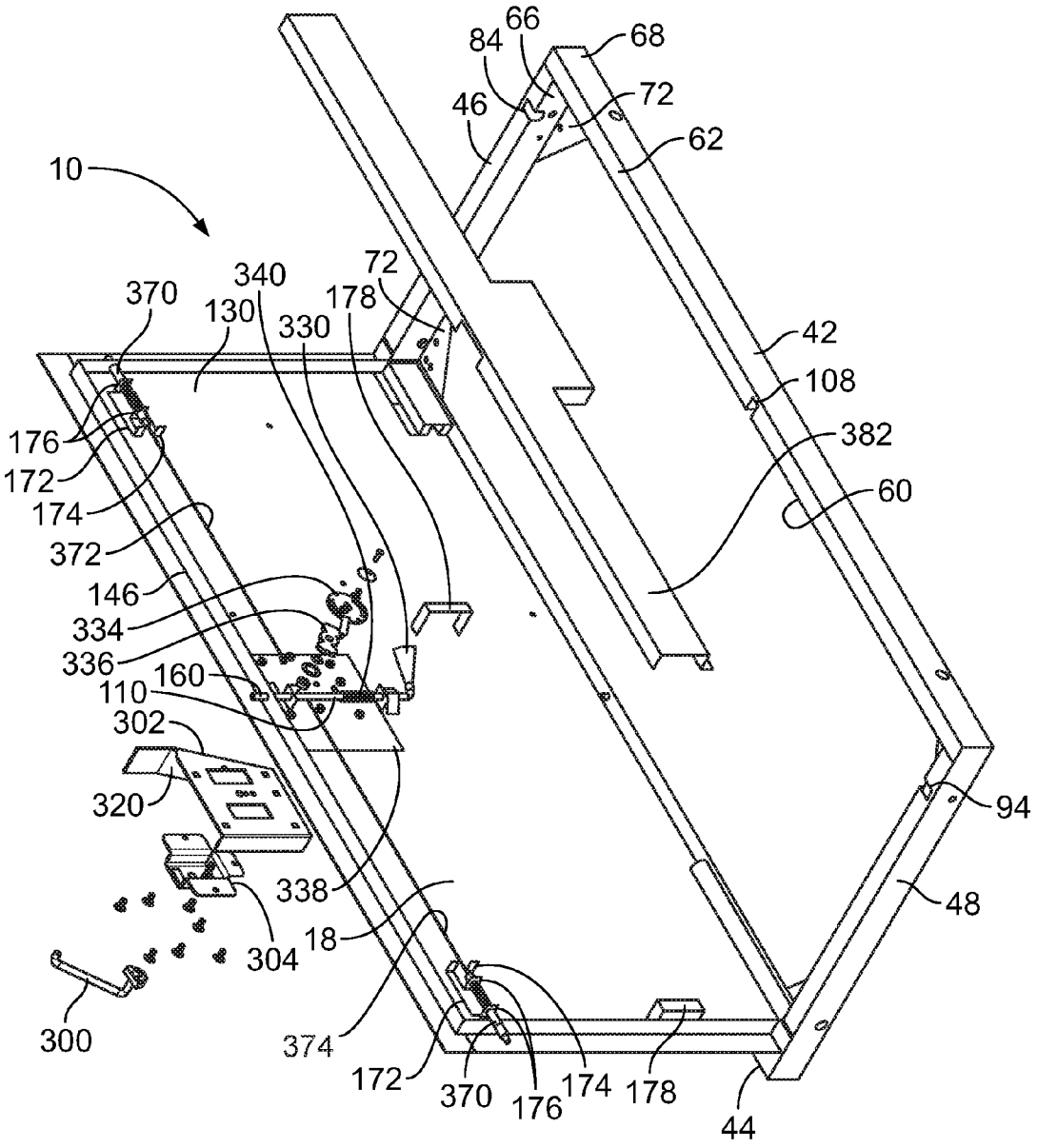
FIG. 11 is an exploded and front perspective view of the assembly of FIG. 4.
Figure 12:
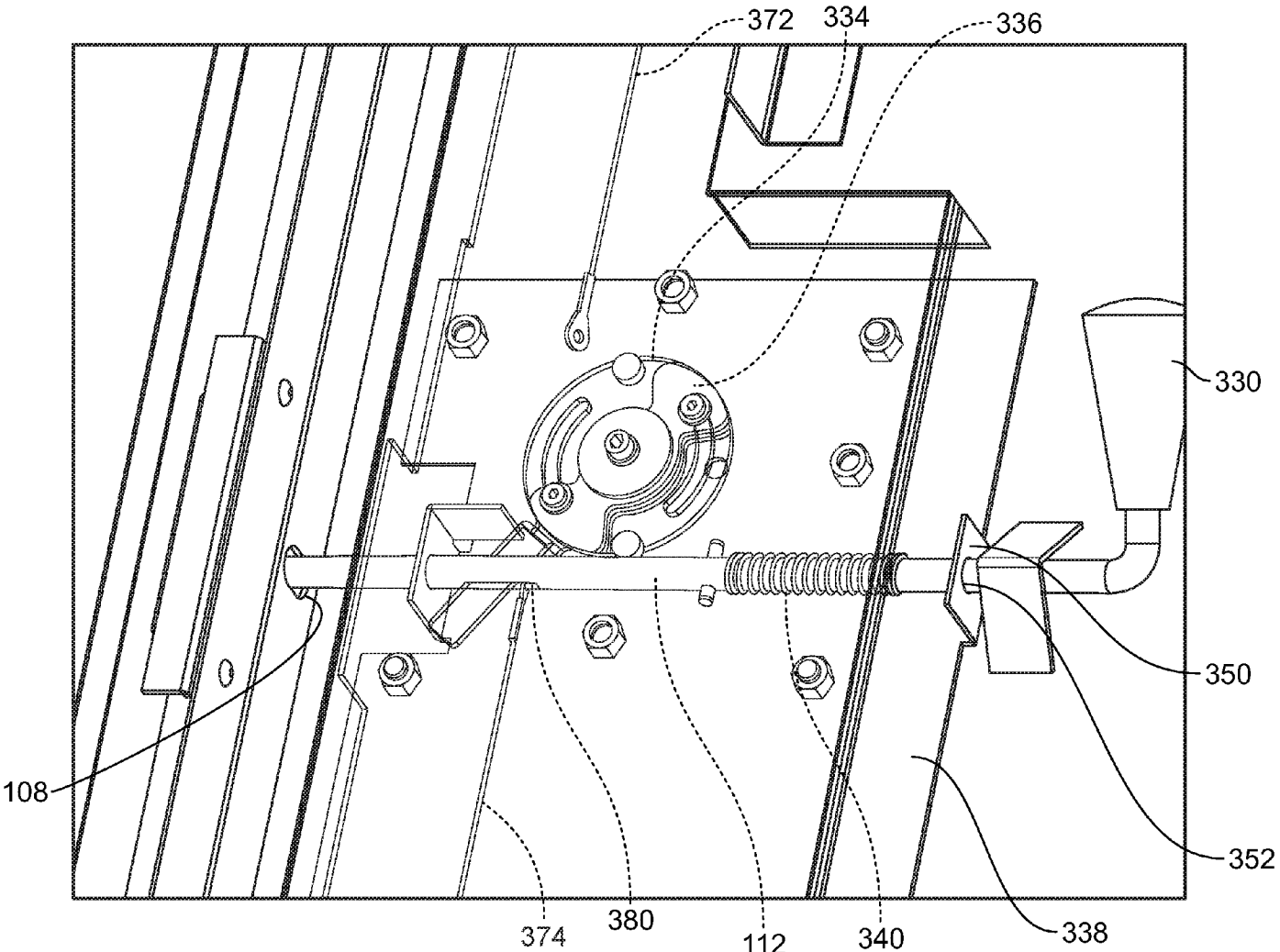
FIG. 12 is an enlarged view of components of the external locking means of the assembly of FIG. 4 associated with the back of the panel with one of the cables shown exploded for illustrative purposes.
Figure 13:
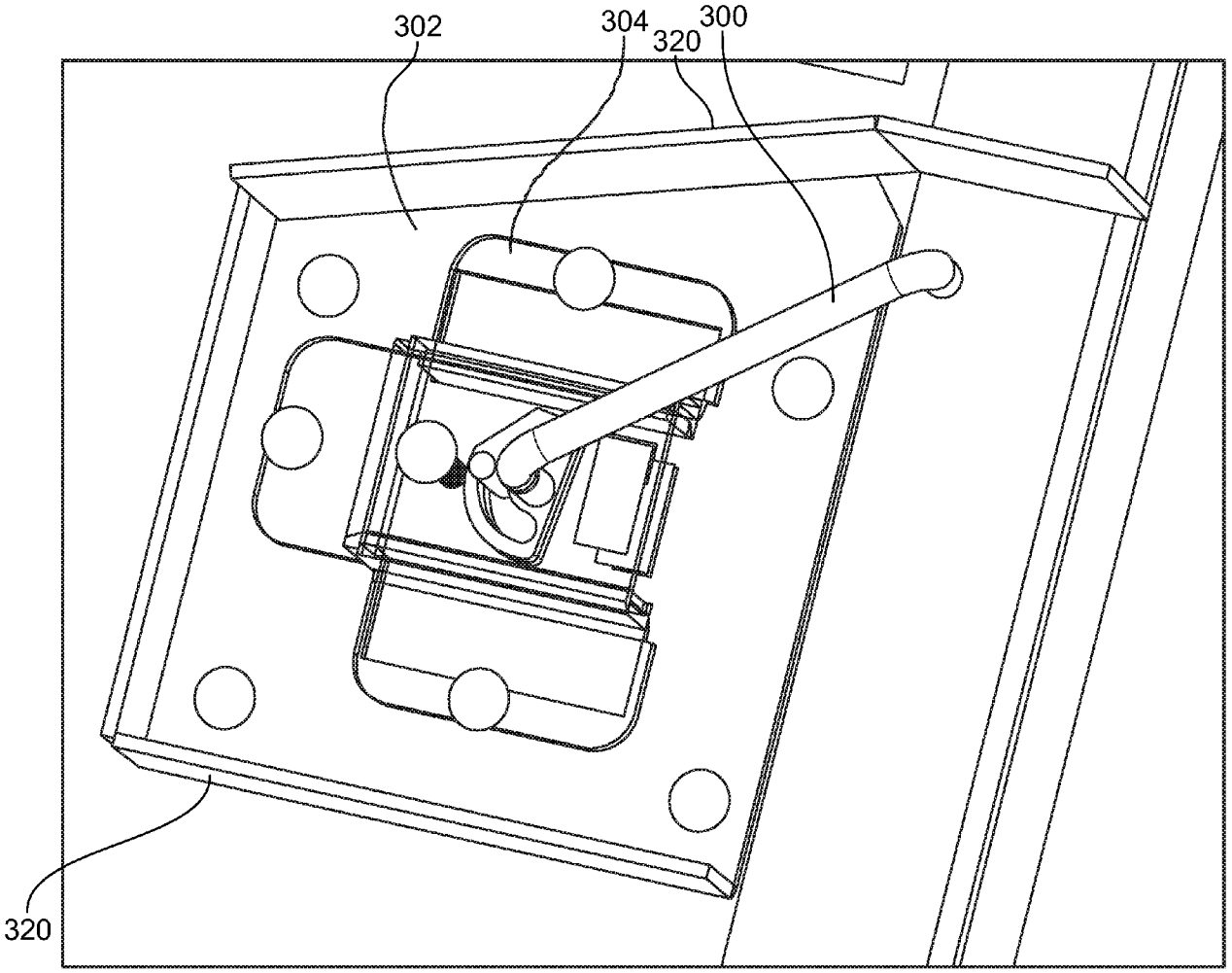
FIG. 13 is an enlarged view of the external locking means of FIG. 4 associated with the front of the panel.
Figure 14:
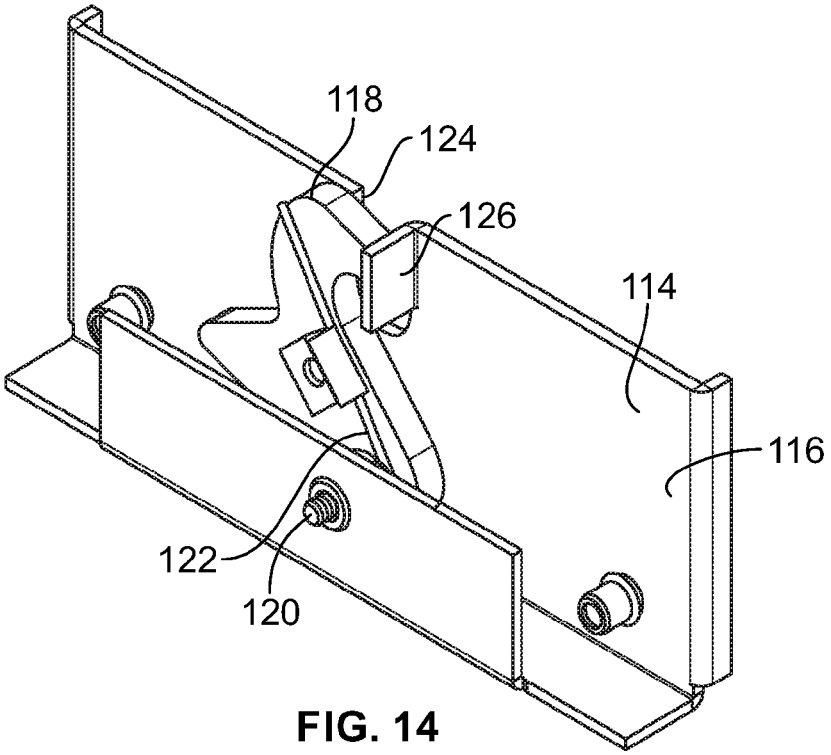
FIG. 14 is an enlarged view of one of the latching structures for receiving one of the latch bolts of the locking means.
Figure 15:
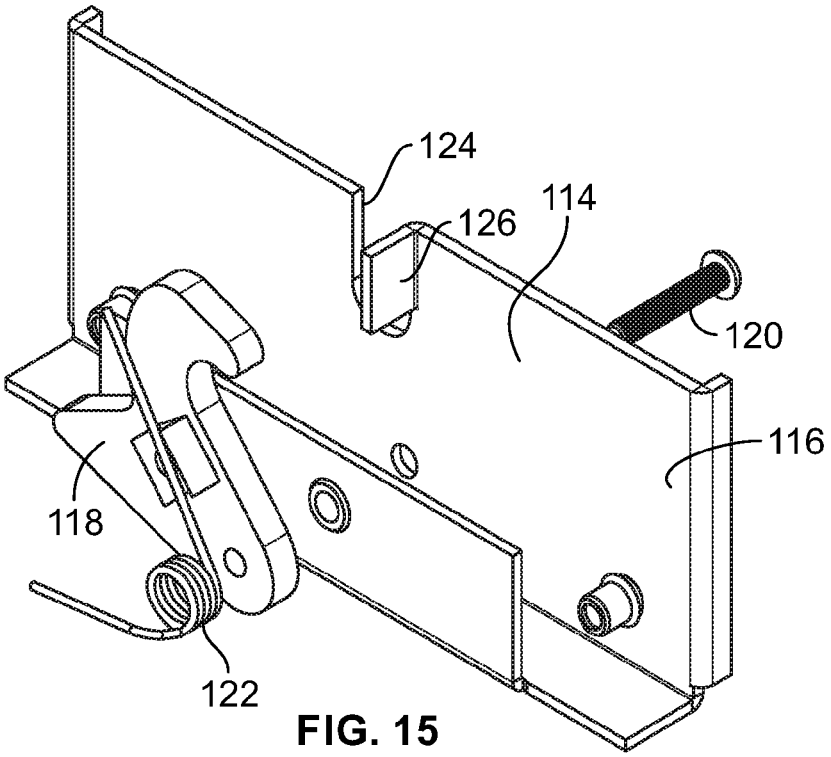
FIG. 15 is an enlarged view of one of the latching structures for receiving one of the latch bolts of the locking means shown, for illustrative purposes, with the latching weldment removed.

FIGS. 1-15 illustrate an assembly 10 for securely enclosing an opening in the form of a door opening 12 of a house or other building. The assembly 10 comprises generally a frame 14, a panel 18 pivotally secured to the frame 14, a pair of installation bars 26, and a plurality of threaded rods 28. The illustrated assembly 10 may be used to secure the frame 14 and panel 18 to a wall 38 or other structure of the building over the opening 12 to enclose and secure the opening 12 to prevent or substantially reduce the ability of trespasser from entering the building through the opening. The opening 12 may be in the form of a door opening, window opening or any other opening of a building. In the illustrated embodiment, the installation bars 26 are disposed inside the building to secure the frame 14 and the panel 18 to the wall 38.

The assembly 10 also includes locking means as described below that includes an internal locking means that may be manually operated from only inside the building and an external locking means that may be manually operated from outside or inside the building. The internal locking means and the external locking means are selectively securable to the panel such that the installer or the customer may decide during or prior to installation whether the panel will be manually lockable and unlockable from only the inside of the building or may be manually lockable and unlockable from both the outside and inside of the building. For example, for a building with many openings, the installer or the customer may decide to install the assembly 10 with an external locking means on a front door of the building and install assemblies 10 with internal locking means on some or all of the other openings. With an illustrated embodiment of the present disclosure, the panel 18 is securable selectively to the internal locking means or the external locking means.

The frame 14 in accordance with an illustrated embodiment of the present disclosure comprises a pair of parallel vertical members 42 and 44 and a pair of parallel horizontal members 46 and 48 defining an opening 60. The vertical members 42 and 44 and horizontal members 46 and 48 may be in the form of tubes or have any other construction. The ends of the vertical members 42 and 44 may be welded or otherwise secured to the ends of the horizontal members 46 and 48 to form a rectangular configuration. The frame 14 comprises a back 62, a front 64, an inner face 66 facing the opening 60 and an outer face 68 facing away from the opening 60. The frame 14 also includes four triangular members 72 welded or otherwise secured to the vertical members 42 and 44 and horizontal members 46 and 48 at or near the back 62 of the frame 14 in the corners of the frame 14 extending towards the opening 60. Each triangular member 72 defines a plurality of holes 78 for selectively receiving the threaded rods 28 to secure the frame 14 to the building.

The inner face 66 of horizontal member 46 defines a hole for receiving a bolt in the form of an upper hinge pin 190 of the panel 18 and a hole 84 for receiving a latch bolt 90 associated with the locking means of the panel assembly 16, respectively. The inner face of horizontal member 48 defines a hole to receive a lower hinge pin of the panel 18 and a hole 94 to receive another latch bolt 370 associated with the locking means of the panel assembly 16, respectively. The inner face 66 of vertical member 42 defines a hole 108 to receive a latch bolt 110 or 112 associated with the locking means.

In the illustrated embodiment, each of the vertical and horizontal members 42, 44, 46 and 48 of the frame 14 comprises a 2"×3" tube which may be comprised of steel in the 12-18 gauge range, or any other suitable steel or metal. A latch assembly 114 is disposed in each of the horizontal members 46 and 48 adjacent each of holes 84 and 94, and another latch assembly 114 is disposed in vertical member 42 adjacent hole 108. Each illustrated latch assembly 114 comprises a housing 166, a latch weldment 118, a fastener 120 for securing to the frame 14, and a torsion spring 122. The housing 166 defines an opening 124 and an adjacent weldment stop 126.

Although the illustrated frame 14 comprises two vertical members 42 and 44 and two horizontal members 46 and 48 and has a generally rectangular configuration to complement the configuration of a conventional door opening, the frame 14 may comprise any other number of members and have any other suitable configuration to complement or otherwise substantially enclose any opening of the building in accordance with other embodiments of the present disclosure. The frame 14 and each of its components may have any other suitable construction and configuration in accordance with other embodiments of the present disclosure.

The illustrated panel 18 has a back 130 and a front 132 and is sized to enclose the opening 60 of the frame 14. The panel 18 is constructed of cold rolled steel or any other suitable steel or metal. The back 130 of the panel 18 includes a bottom strip 140, a top strip 142, and a side strip 146 extending outward from the back 130. The side strip 146 extends substantially perpendicular to the bottom and top strips 140, 142. The strips 140, 142 are positioned to engage the inner face 66 of the frame 14 when the panel is pivoted to the closed position.

The bottom strip 140 includes a hinge pin hole 150 and a latch hole 152. The top strip 142 also includes a hinge pin hole 154 and a latch hole 156. The side strip 146 includes a latch hole 160. The back 130 of the panel 18 includes a protective hinge shroud 170 for protecting the spring pin. The panel 18 also defines a plurality of holes 162 for accommodating selectively the internal locking means and the external locking means.

The back 130 of the panel 18 also has a pair of spaced brackets 172 associated with the locking means. Each bracket 172 includes a passage 174 and a pair of through holes 176 for receiving one of the latch bolts 370. The back 130 of the panel 18 also includes a pair of spaced storage brackets 178 for receiving the installation bars to store the installation bars 26 during storage and/or transportation of the panels and to provide ease of stackability of assemblies 10. The back 130 also has a cylindrical tube 180 also for receiving components of the locking means during storage and/or transportation of the panels 18 and to provide ease of stackability of assemblies 10.

The illustrated panel 18 has a rectangular configuration and is hingedly secured to the frame 14 so that it is pivotable between the open and closed positions by the upper and lower hinge pins 190 and 192 which are received by holes of the frame 14 and holes 152 and 154 of the panel 18, respectively. The illustrated upper hinge pin 190 is in the form of retractable hinge bolt or the like. Although the illustrated panel 18 has a generally rectangular configuration to complement the configuration of a conventional door opening, the panel may have any other suitable configuration to complement or otherwise substantially enclose any door opening of other opening in accordance with other embodiments of the present disclosure. The panel 18 may also have any construction and be constructed of any other material in accordance with other embodiments of the present disclosure.

Each of the illustrated installation bars 26 comprises a long formed steel extrusion comprising an elongated securing member, a pair of elongated walls interconnected with and disposed about the elongated securing member, a pair of elongated flanges interconnected with and disposed about the elongated walls, and a pair of elongated radius portions interconnecting the walls and flanges. The elongated securing member defines a series of spaced elongated slots 200 spaced along its length for aligning with the holes 78 of the triangular members 72. The elongated radius portions are configured to engage the wall 38 inside the building when the panel 18 is secured to the wall 38 inside the building. The elongated radius portions and the elongated walls provide rigidity along the length of the installation bar 26. In accordance with embodiments of the present disclosure, installation bars 26 can instead be inverted such that the securing members engage the wall inside the building.

The installation bars 26 may be about 48" or otherwise in the range of 30"-60" long or may be any other length depending upon the size of opening 12, such that the installation bar extends across a dimension of the opening and can be secured to the wall 38. The installation bars 26 may be formed steel parts and may, for example, be fabricated from pre-galvanized steel sheets in the 12-18 gauge range or any other suitable steel or other material. The blank sizes may be punched in a turret press and then formed in a brake press. The installation bars 26 may have any other configuration in accordance with other embodiments of the present disclosure. Further, the assembly 10 may be secured to the building without installation bars 26 in any other suitable manner.

The threaded rods 28 and washers may be used to secure the installation bars 26 to the frame 14. With the frame 14 and the panel assembly 16 positioned on the outside of the wall 38 of the building and the installation bars 26 on the inside of the wall 38 of the building, the installation bars 26 are moved towards the frame and panel to engage the wall 38 therebetween by manually moving the installation bar 26 towards the frame 14 and panel assembly 16, by rotating the nuts relative to the threaded rods 28 manually, by a hand tool or the like, or by any other suitable means.

The threaded rods 28 may be 24" in length or may be of any other suitable size. The nuts for engaging the threaded rods 28 may be in the form of tamper proof nuts comprising round, angled faces with symmetrical facets in the X and Y planes. Depending upon the application, a special driver may be needed to interface and fasten and unfasten the nuts. The tamper proof nuts are sized to threadingly engage threaded rods. The nuts may be any other type of nut, hardware or securing structure in accordance with other embodiments of the present disclosure. The engaging means may include any other suitable fasteners or other suitable components and structure in accordance with other embodiments of the present disclosure.

When selecting or installing the locking means, the internal locking means or the external locking means may be selected. The illustrated internal locking means is disposed substantially on the back 130 of the panel 18. The internal locking means comprises top and bottom handle assemblies 220 securable to the brackets 172, a central handle assembly 224, a mounting plate 230 for securing the central handle assembly 224 to the back 130 of the panel 18, the latch assemblies 114, and fasteners such as hex nuts and carriage bolts, receivable by the holes 162 for securing the mounting plate 230 to the back 130 of the panel 18. Each of the top and bottom handle assemblies 220 includes a handle 250, and the latch bolt 370. The latch bolts 370 are receivable by the respective holes 152 and 154 of the bottom and top strips 140 and 142 of the panel 18 and holes 84 and 94 of the frame 14. The latch bolts 370 are also received by the passage 174 and the holes 176 of respective brackets 172. The latch bolts 370 are releasably engageable with respective latch bolt assemblies 114 in response to rotation of respective handles 250.

The central handle assembly 224 includes a handle 270, a latch bolt 112 receivable by the hole 160 of the side strip 146 and the hole 108 of the vertical member 42 of frame 14 for engaging the frame 14. Each of handle assemblies 220 and 224 may also include other hardware such as a latch spring 260 and a slotted spring pin 262. The internal locking means may be manually operated from the inside only. Each of the latch bolts 370 is selectively engageable and disengageable with a respective latch assembly 114 in response to rotation of the handle 270.

The internal locking means is manually operable from the inside of the building only. To engage or lock the internal locking means, each of the handles 250 and 270 is separately turned or rotated causing the respective latch pin to engage a respective latch assembly 114. To disengage or unlock the internal locking means, each of the handles 250 and 270 is separately turned or rotated in an opposition direction to cause the respective latch bolt 370 to disengage the respective latch assembly 114. When the internal locking means is disengaged, the panel 18 may be pushed or pulled to open or close it. Although the internal locking means is manually operable from the inside of the building only, electronic or other technology may be added to cause the internal locking means to be opened from outside of the building. Internal locking means with such technology is still considered to be within the scope of this disclosure because the internal locking means continues to be manually operable from the inside of the building only.

The external locking means is manually operable from the outside or inside of the building and includes components disposed on the back 130 and front 132 of the panel 18. The external locking means comprises the following components associated with the front 132 of the panel 18: a handle 300, a mounting plate 302 secured to the front of the panel, a lock shell 304 secured to the mounting plate 302, and hex nuts and fasteners for securing the mounting plate to the front 132 of the panel 18. The mounting plate 302 includes a shroud wall 320. The interim locking means may have any other construction and operate in any other manner in accordance with other embodiments of the present disclosure. The lock shell 304 can have any suitable structure depending on the design of the components of the locking means. Although the external locking means is manually operable from the outside of the building only, electronic or other technology may be added to cause the external locking means to be opened from inside of the building. External locking means with such technology is still considered to be within the scope of this disclosure because the external locking means continues to be manually operable from the outside of the building only.

The external locking means comprises the following components associated with the back 130 of the panel 18: a handle 330 including a center latch bolt 112, a rotary motion cam 334, a dog bone cam assembly 336, a mounting plate 338 for mounting on the back 130 of the panel 18, a torsion spring 340 engaging the center latch bolt 112 and the mounting plate, the latch assemblies 114, and hardware for securing together on the back of the panel the handle 330 and cams 334, such as for example, a head cap screw, a lock washer, a bearing washer, a pair of posts, a pair of flat washers, a shoulder screw and a pair of bushings. The mounting plate 338 includes a guide 350 defining a hole 352 receiving the latch bolt 110. The external locking means also includes a pair of latch bolts 370 for engaging and disengaging the frame 14 and panel 18 and an upper cable 372 and a lower cable 374 connecting the hinge and latch bolts to the latch bolt 112. The latch bolt 112 includes a slot 380 for engaging the rotary motion cam 334 and for securing the cables 372 and 374 to the handle. A protective shroud 382 may be secured to the back 130 of the panel 18 for protecting the cables 372 and 374 and latch assemblies. The external locking means also includes a lock for locking and unlocking the handle that may be in the form of a combination lock, an electronic lock or any other lock that can be activated in any manner. When the lock is in a locked condition, the handle 330 does not operate to unlock the panel 18. When the lock is in an unlocked condition, the handle 330 may be rotated to unlock the panel 18.

The rotary motion cam 334 and the dog bone cam 336 operate to permit the panel 18 to be opened or locked from the outside by either rotation of the outside handle 300 or from the inside rotation of the inside handle 330. Rotation of either such handle 300 or 330 causes the engagement or disengagement of the latch bolt 112 and the frame and engagement or disengagement of the hinge latch bolts and the frame 14.

The rotary motion cam 334 and the dog bone cam 336 facilitate operation of the external locking means to be operable from both the outside or inside of the building. Once the handle 300 is unlocked, to open from the outside, the handle is rotated to disengage the latch bolt 112 and the latch bolts 370 from the frame 14. To open the panel 18 on the inside, however, the handle 330 is rotated to disengage the latch bolt 112 and the latch bolts 370 from the frame 14. Unlocking from the inside can be achieved even if the handle 330 remains locked. The external locking means may have any other construction and may operate in any other manner in accordance with other embodiments of the present disclosure.

The panel 18 may be used with either the internal or external locking means depending upon whether the panel is intended for internal opening only or external opening. Once the desired locking means is selected, the assembly 10 can be secured over the opening 12 in any suitable manner. The installation of the internal or external locking means can occur before, during and/or after securing the assembly to the structure.

Securing the panel 18 to the structure may, for example, occur as follows: The frame 14 and the panel 18 are pivotally secured together and the frame is placed substantially within the opening 12 with the back of the frame 14 engaging the outside of the wall 38. The threaded rods 28 are inserted into one of the holes 78 of each of the triangular members 72. One of the installation bars 26 is placed over two of the threaded rods 28 to extend horizontally across the opening 12 on the inside of the wall 38. The frame 14 is held against the wall 38 from the outside. The plurality of slots 200 of the installation bar 26 and the plurality of holes 78 of the triangular members 72 provide alternative positioning for the threaded rods 28. The tamper proof nuts are fastened to the threaded rods 28 on the opposite side of the triangular members 72 and tightened to engage the installation bars 26 with the structure on the inside of the building and to engage the frame with the wall 38 on the outside of the building. This process is repeated at the bottom of the frame 14 with the other installation bar. The panel 18 is then locked to the closed position through the internal or external locking means. Before, during or after the installation, the internal or external locking means is installed.

Additionally, with the illustrated assembly 10, structure can be welded to the frame 14 to increase the width or the length of the frame 14 to accommodate openings of different sizes. For example, skirts or fins can be welded to the sides, top or bottom of the frame to increase the size of the frame. The assembly 10 in accordance with other embodiments of the present disclosure may also include extenders (not shown) that can be secured to the top, bottom or side of the frame that may come in sizes of 6", 9", 12", 15", and 18" or any other suitable sizes. The extenders may be secured to any of the vertical and horizontal members 42, 44, 46 or 48 to extend the length or width of the assembly 10 to fit any opening or to be secured over windows or decorative structure disposed about the opening.

The illustrated embodiment of the present disclosure provides many benefits. For example, different panels 18 do not need to be manufactured depending upon whether internal or external locking is employed. Instead, the installer can use the panels 18 regardless of whether internal or external locking is desired resulting in reduced manufacturing costs and distribution costs. Further, it provides more flexibility in the re-useability of these panel assemblies because panels 18 are re-usable potentially over and over again when a panel of an assembly 10 installed for an internal locking application can be removed and re-used in an external locking application, and vice versa.

The assembly 10 of the present disclosure is relatively easy and cost effective to manufacture and tends to be extremely reliable in protecting entry into a building. The assembly 10 can be installed to the wall 38 or other structure of the building quickly and efficiently. The assembly 10 also does not damage the structure and also can be quickly and efficiently removed for re-use. The assembly 10 is also readily removable and readily reusable with other openings. There is minimal hardware outside the building. Additionally, when installed, the panels 18 are aesthetically pleasing, especially as compared to wooden window boards that are commonly used in an effort to secure door or window openings.

While embodiments have been illustrated and described in the drawings and foregoing description, such illustrations and descriptions are considered exemplary and not restrictive in character, it being understood that only illustrative embodiments have been shown and described and that all changes and modifications that come within the spirit of the invention are desired to be protected. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

I claim:

1. An assembly for securely enclosing an opening defined by a building structure having an inside and an outside, the assembly comprising:

a frame sized to be disposed to substantially surround the opening and engage the structure;

a panel pivotally securable to the frame and sized to substantially cover the opening, the panel having a front and a back; and locking means for selectively locking the panel to the frame in a closed position and unlocking the panel so that it can be pivoted to an open position, the locking means comprising selectively only one of an internal locking means manually operable only from the inside of the building and an external locking means manually operable from the outside of the building;

the internal locking means having a first handle assembly configured to be secured to the back of the panel, the first handle assembly comprising a first handle and a first latch bolt, and, when the internal locking means is selected, the first handle assembly is configured to selectively engage and disengage the first latch bolt and the frame for selectively locking and unlocking the panel;

the external locking means comprising a second handle assembly including a second handle and a second latch bolt operatively connectable to the second handle of the external locking means, and, when the external locking means is selected, the second handle of the external locking means is configured to selectively engage and disengage the second latch bolt of the external locking means and the frame for selectively locking and unlocking the panel;

wherein the panel includes a pair of spaced brackets secured to the back of the panel and the external locking means further includes a third latch bolt, the second and third latch bolts of the external locking means each configured to engage a respective bracket and to selectively engage or disengage the frame during engagement or disengagement of the respective second and third latch bolt of the external locking means and the frame; and wherein the external locking means further includes a cable assembly operatively associated with the second handle to selectively engage or disengage the respective second latch bolt of the external locking means to facilitate engagement and disengagement of the respective first or third latch bolt of the external locking means and the frame.

2. The assembly of claim 1 wherein the internal locking means comprises a first mounting plate for securing the first handle to the back of the panel and the external locking means includes a second mounting plate for securing the second handle to the front of the panel.

3. The assembly of claim 2 further comprising at least one fastener and wherein the panel defines at least one hole, the fastener receivable by the hole for selectively securing the first mounting plate to the back of the panel and the second mounting plate to the front of the panel.

4. The assembly of claim 2 further comprising plurality of fasteners and wherein the panel defines a plurality of holes, at least some of the fasteners receivable by at least some of the holes for selectively securing the first mounting plate to the back of the panel and the second mounting plate to the front of the panel.

5. The assembly of claim 1 wherein the panel also includes a bracket on the back and the internal locking means comprises a third handle assembly comprising a third handle engaged with the bracket and a third latch bolt moveable by the third handle of the third handle assembly relative to the bracket to selectively engage or disengage the third latch bolt of the third handle assembly and the frame.

6. The assembly of claim 1 wherein the panel also includes a pair of brackets on the back and the internal locking means comprises a pair of third handle assemblies on the back, the brackets being spaced from each other along a length of the panel and the third handle assemblies being spaced from each other along a length of the panel, each third handle assembly comprising a third handle engaged with a respective bracket and a third latch bolt moveable by the third handle relative to the respective bracket to selectively engage or disengage the third latch bolt of the third handle assembly and the frame.

7. The assembly of claim 6 wherein the first latch assembly of the internal locking means is engageable with the first latch and each third latch assembly engageable with a respective third latch bolt.

8. The assembly of claim 1 wherein the internal locking means further includes a latch spring associated with the first latch bolt.

9. The assembly of claim 1 wherein the external locking means further includes a protective shroud securable to the back of the panel to enclose the cable assembly.

10. The assembly of claim 1 further comprising:

at least one installation bar to secure the frame to the building structure; and a pair of spaced brackets on the back of the panel for receiving and storing the installation bar during transportation of the assembly when the installation bar is not secured to the frame or building structure, the panel including a strip and one of the spaced brackets positioned adjacent the strip.

11. The assembly of claim 1 further including at least one installation bar to secure the frame to the building structure and a pair of spaced brackets on the back of the panel for receiving and storing the installation bar during storage or transportation of the assembly.

12. The assembly of claim 1 further including at least one installation bar to secure the frame to the building structure and a tube on the back of the panel for receiving and storing at least some of the locking means during storage or transportation of the assembly when the installation bar is not secured to the frame or building structure.

13. The assembly of claim 1 wherein the door is comprised of cold rolled steel.

14. The assembly of claim 1 further comprising at least one installation bar to secure the frame to the building structure.

15. The assembly of claim 14 wherein the frame defines a plurality of holes and the installation bar defines a plurality of slots and further comprising a plurality of fasteners, each fastener received within a respective one of the holes of the frame and a respective one of the slots of the installation bar to secure the frame to the structure.

16. The assembly of claim 14 further comprising a pair of installation bars, one installation associated with a top of the frame and one installation bar associated with a bottom of the frame.

* * * * *